United States Patent [19]

Gies

[11] Patent Number: 4,712,328

[45] Date of Patent: Dec. 15, 1987

[54] TREE STAND HAVING A CASTING WITH CLAMPING DEVICES FOR HOLDING A TREE TRUNK

[76] Inventor: Jakob Gies, Solmser Strasse 14, D-6434 Niederaula I, Fed. Rep. of Germany

[21] Appl. No.: 20,519

[22] Filed: Mar. 2, 1987

[30] Foreign Application Priority Data

Mar. 1, 1986 [DE] Fed. Rep. of Germany ..... 3606778

[51] Int. Cl.[4] ..... A01G 17/06

[52] U.S. Cl. ..... 47/40.5; 47/44; 248/516

[58] Field of Search ..... 47/40.5, 44; 248/516, 248/519; 269/156, 229; 81/51.18

[56] References Cited

U.S. PATENT DOCUMENTS 2,242,270 5/1941 Sims ..... 47/40.5

2,478,278 8/1949 Kiesow ..... 47/40.5

*Primary Examiner*—Robert A. Hafer

*Assistant Examiner*—Bradley M. Lewis

*Attorney, Agent, or Firm*—Collard, Roe & Galgano

[57] ABSTRACT

A tree stand for holding and supporting a tree having a trunk, the stand having a casing with an inner wall with spirally-curved surfaces, and a guide piece disposed in the center of the casing having guide curves each with a curvature corresponding with the curvature of the spirally-curved surfaces of the inner wall of said casing. Clamping cylinders are disposed inside of the casing between the guide piece and the spirally-curved surfaces of the casing inner wall. A cover is rotatably mounted over the top of the casing and is coupled to each of the clamping cylinders so that when the cover is rotated, the clamping cylinders move within the spirally-curved surfaces of said guide piece and said inner wall of said casing so that said cylinders spirally close upon the trunk of the tree. The cover is also provided with a lock coupled to the casing so that the cover can be locked in place with respect to the casing after the tree trunk is gripped. Gripping recesses are fitted into the top surface of the cover to aid in rotating the cover. The cover includes a central opening for receiving the tree trunk.

12 Claims, 5 Drawing Figures

TREE STAND HAVING A CASTING WITH CLAMPING DEVICES FOR HOLDING A TREE TRUNK

This invention relates to a tree stand comprising a casing with clamping devices for holding a tree trunk.

BACKGROUND OF THE INVENTION

A tree stand is known consisting of a casing base fitted with a threaded and adjustable cone that can be screwed into the base. The casing base has radially movable clamping shoes which have on the upper, outwardly-directed edge, a bevel upon which the travelling or adjustable cone acts. By turning the travelling cone, the clamping shoes are displaced towards the center of the casing base until the tree trunk is securely clamped. This tree stand can be used only for a small range of tree trunk diameters, because the slant at the back end of the clamping shoes cannot exceed a certain angle, since thereafter, it is not possible to horizontally displace the clamping shoes.

SUMMARY OF THE INVENTION

It is therefore an object of the invention to provide a tree stand which can be used on a wide range of tree trunk diameters.

Accordingly, the invention provides a casing having an inner wall with several spirally-curved surfaces. A guide piece is fitted in the center of the casing with several guide curves having a curvature which corresponds to the curved surfaces of the inner walls of the casing. Between the curved surfaces are disposed clamping devices for gripping the tree trunk. These clamping devices are preferably clamping cylinders. The rotatable operating components of the casing for the clamping devices are rotated by a cover, which can be rotated relative to the casing, and which contains the operating components for the clamping devices.

The guide curves of the guide piece are provided with end stops for the clamping cylinders so that the movement of the clamping cylinders is limited within an assigned range in the casing, which for three clamping cylinders amounts to about 120°. Each operating component serves as a cap to grip the clamping cylinder so that through the cover, the clamping cylinders are guided without play in the casing. This embodiment of the tree stand can be used for tree trunks between 50 mm to about 100 mm in diameter.

In an advantageous embodiment, the curved surfaces on the inner wall of the casing and the corresponding clamping cylinders are fitted with gear teeth to provide a positive engagement and thus securely clamp the tree trunk in the tree stand.

Guide slots are provided in the top of the casing to guide the cover which is fitted with pins extending into the guide slots. The cover can be locked in position on the casing by means of a bolt lever, so that the tree trunk will not disengage from the tree stand.

In an advantageous embodiment, the clamping cylinders are provided with slide shoes on their lower side to ease the sliding of the clamping cylinders on the casing bottom.

Other objects and features of the present invention will become apparent from the following detailed description considered in connection with the accompanying drawings which disclose a single embodiment of the invention.

BRIEF DESCRIPTION OF THE DRAWINGS

In the drawings, wherein similar reference characters denote similar elements throughout the several views:

FIG. 3 is a cross-sectional view taken along line III—III of FIG. 1, with the cover on;

DETAILED DESCRIPTION OF THE PREFERRED EMBODIMENT

Figure 1:
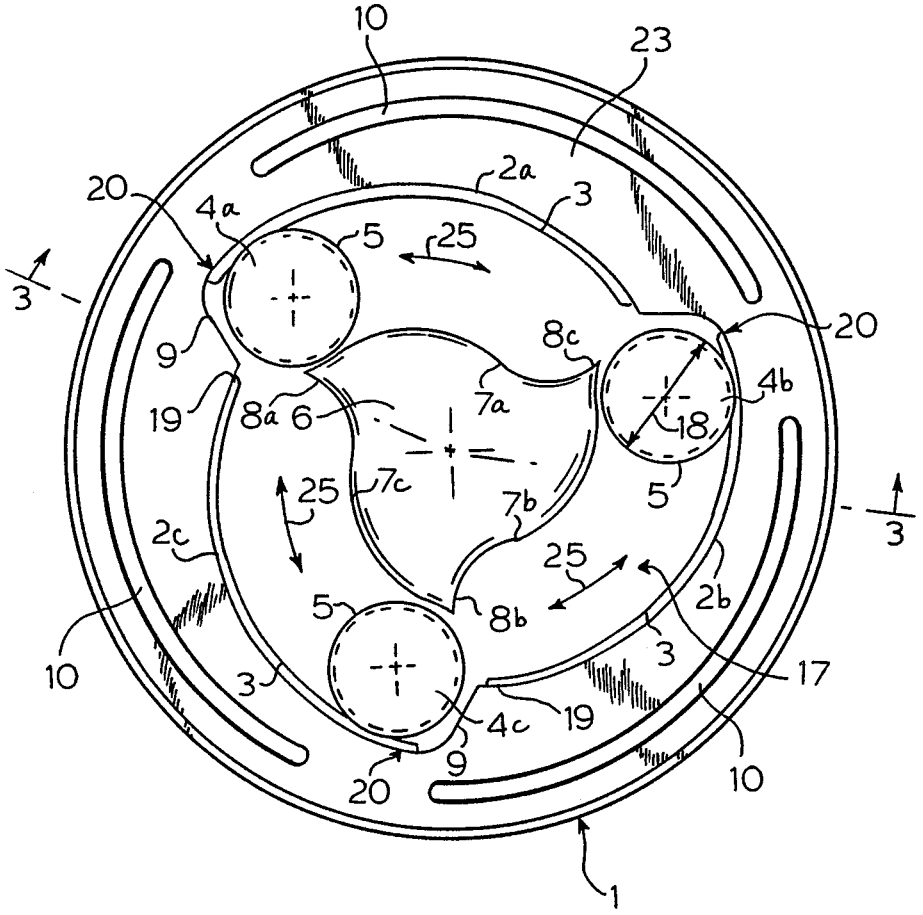
FIG. 1 is a plan view of the casing of the tree stand according to the invention with the cover removed, the clamping cylinders being positioned at the maximum distance from the center of the casing.

Referring to FIG. 1, there is shown a casing with an inner casing wall 1*a* having three spirally-curved surfaces 2*a*, 2*b* and 2*c*. One end 19 of the spirally-curved surfaces is located closer to the center of the casing than the other end 20. Between end 20 of the curved surface and end 19 of the adjoining curved surface is formed a shoulder 9. Each of these surfaces 2*a*, 2*b* and 2*c* is fitted with gear teeth 3 which interact with gear teeth 5 of a set of clamping cylinders 4*a*, 4*b* and 4*c*.

Figure 2:
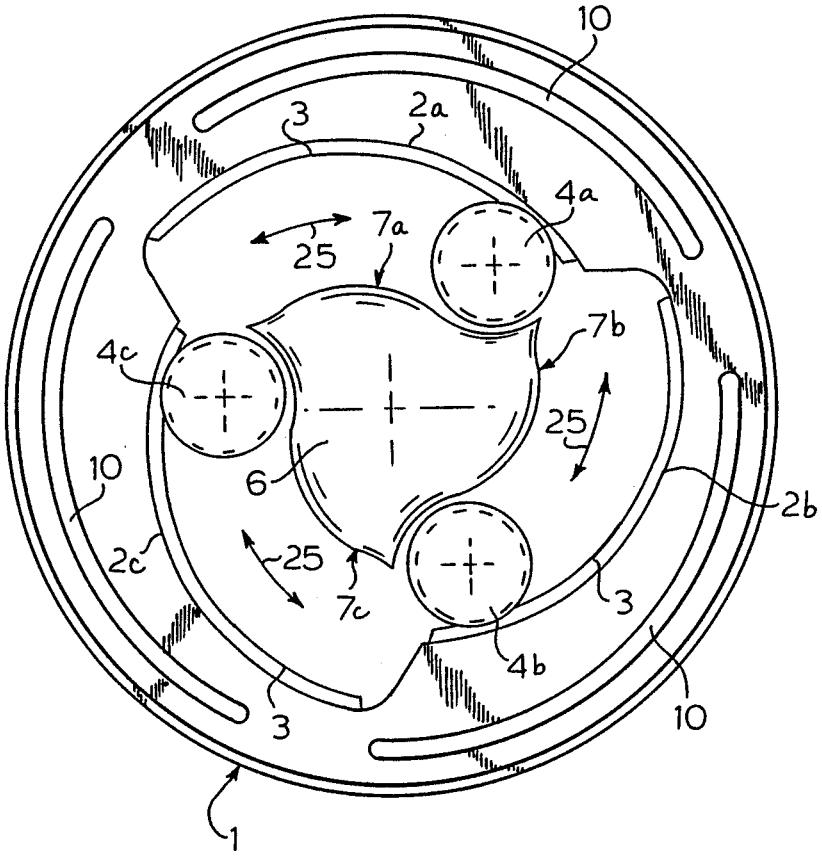
FIG. 2 is a plan view of the casing with the cover removed, the clamping cylinders being positioned at the minimum distance from the center of the casing.

Disposed in the center of casing 1 is a guide piece 6 fitted integrally on the casing bottom. Guide piece 6 is provided with guide curves 7*a*, 7*b* and 7*c*, the curvature of which matches curved surfaces 2*a*, 2*b* and 2*c*. The distance between guide curves 7*a*, 7*b* and 7*c* and spirally-curved surfaces 2*a*, 2*b* and 2*c* matches the lower diameter of clamping cylinders 4*a*, 4*b* and 4*c*. Each guide curve 7*a*, 7*b* and 7*c* has a stop 8*a*, 8*b* and 8*c* disposed therein. When the clamping cylinders 4*a*, 4*b* and 4*c* are at stops 8*a*, 8*b* and 8*c*, they are at a minimum distance from the center of the casing, as shown in FIG. 2.

Likewise, the clamping cylinders are spaced the maximum distance from the center of the casing when they are positioned at shoulder 9, as shown in FIG. 1.

Figure 3:
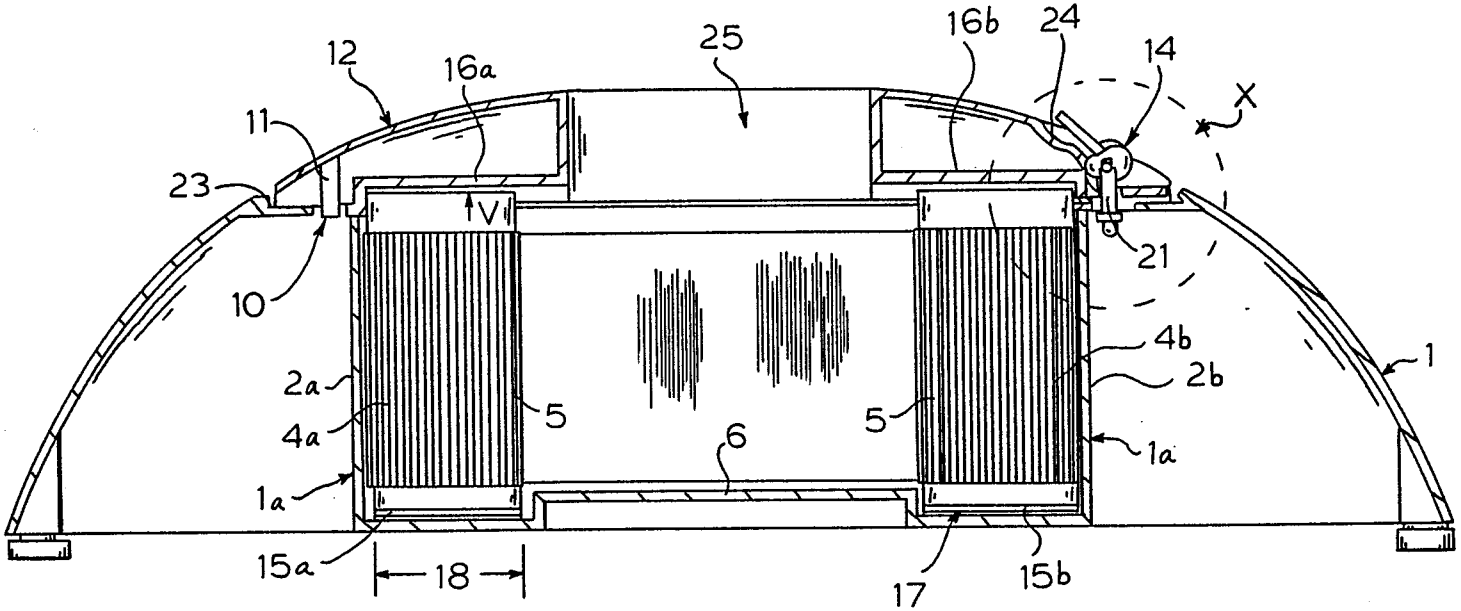
Figure 4:
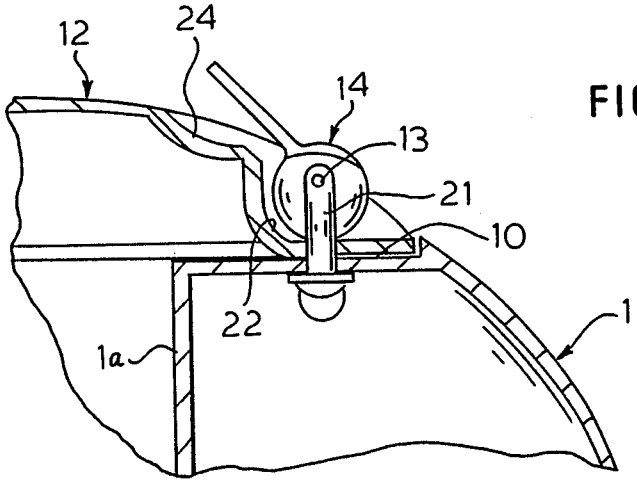
FIG. 4 is an enlarged view of the detail X in FIG. 3.

Guide slots 10 are formed in the top section 23 of the casing. Guide pins 11 of cover 12 extend into the slots 10 as shown in FIG. 3. In addition to guide pins 11, the cover is held in place by a clamping pin 21. Pin 21 has an eccentric axis 13 which is connected with a bolt lever 14 fitted in a recess 22 of cover 12 formed in the upper section of the casing, as shown in FIG. 4. After the tree trunk is clamped, the cover is locked in place on casing 1 by pivoting the bolt lever 14 on its eccentric axis so that the bolt lever grips the surface of recess 22.

Figure 5:
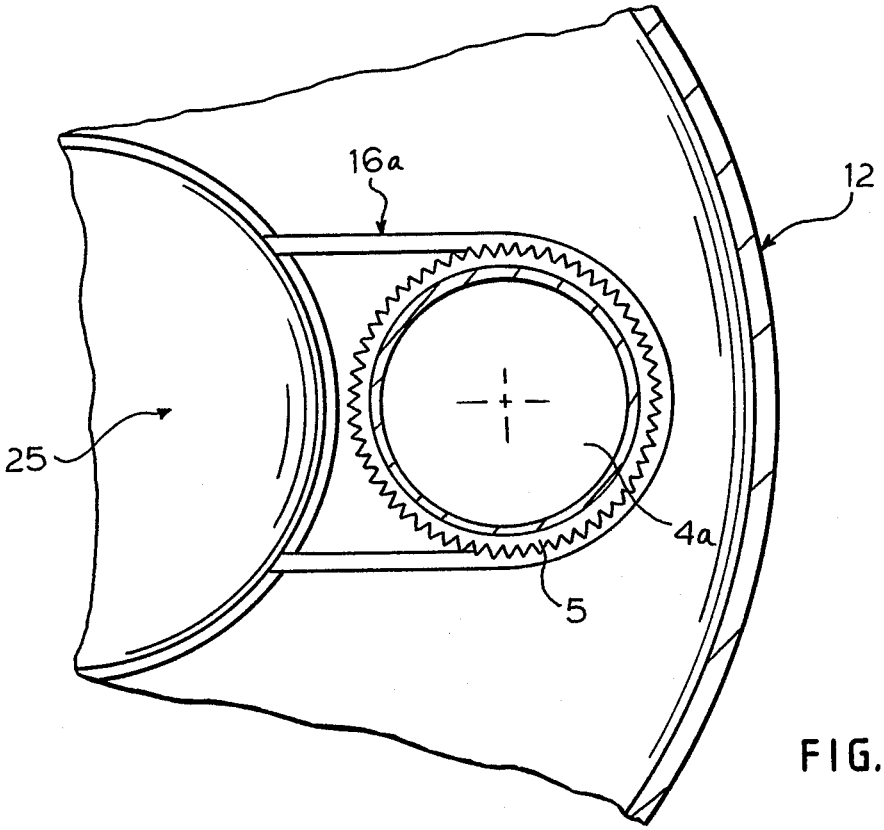
FIG. 5 is a plan view of the underside of the cover shown in the direction of the arrow V in FIG. 3.

In FIG. 3, clamping cylinders 4*a*, 4*b* and 4*c* are provided on their underside with slide shoes 15*a*, 15*b* and 15*c* for easing the sliding of the clamping cylinders on casing bottom 17. In FIGS. 3 and 5, it can be seen that the operating components 16*a*, 16*b* and 16*c*, fitted in cover 12 and defined as semi-circular caps, grip clamping cylinders 4*a*, 4*b* and 4*c* so that when the cover is rotated on the top section of the casing, the clamping cylinders move along curved surfaces 2*a*, 2*b* and 2*c* in the direction of arrow 25 (FIG. 2). The clamping cylinders and particularly slide shoes 15*a*, 15*b* and 15*c* move along the path formed by the spirally-curved surfaces 2*a*, 2*b* and 2*c*, and the curves 7*a*, 7*b* and 7*c* at the casing bottom 17. During this movement, the distance of the clamping cylinders with respect to the center of the casing is gradually reduced, thus clamping the tree trunk.

Cover 12 also includes gripping recesses 24 fitted in the cover surface to allow the cover to be easily rotated on the casing.

The center of cover 12 has an opening 25 for inserting the tree trunk. After the tree trunk is inserted, cover 12 which grips each of the three cylinders in operating caps 16*a*, 16*b* and 16*c*, is rotated so that the cylinders are rotated from their position, as shown in FIG. 1, toward their position, as shown in FIG. 2. The cylinders move between guide surfaces *7a*, *7b* and *7c* and spirally-curved surfaces 2*a*, 2*b* and 2*c* until the cylinders contact and grip the surface of the tree trunk. The cover is then locked into place by rotating bolt lever 14 mounted on its eccentric pin 13 until the bolt lever grips surface 22 on cover 12 locking the cover from further rotation.

While only a single embodiment of the invention has been shown and described, it will be obvious that many changes and modifications may be made thereunto, without departing from the spirit and scope of the invention.

What is claimed is:

1. A tree stand for holding and supporting a tree having a trunk comprising:

a casing having an inner wall with spirally curved surfaces;

a guide piece disposed in the center of said casing, said guide piece having guide curves each with a curvature corresponding with the curvature of said spirally-curved surfaces of the inner wall of said casing;

clamping cylinders disposed inside said casing between said guide piece and said spirally-curved surfaces of said casing inner wall; and means for moving said clamping cylinders within the spirally-curved surfaces of said guide piece and said inner wall of said casing so that said cylinders spirally close upon the trunk of the tree.

2. The tree stand according to claim 1, additionally comprising a cover rotatably disposed on said casing and said means for moving said cylinders comprises operating components disposed on the inside surface of said cover and coupled to said clamping cylinders.

3. The tree stand according to claim 1, wherein said guide curves of said guide piece additionally comprise stops for limiting the movement of said clamping cylinders.

4. The tree stand according to claim 1, wherein said spirally-curved surfaces of said casing inner wall and said corresponding clamping cylinders are fitted with mating gear teeth.

5. The tree stand according to claim 1, wherein said casing includes guide slots formed in the top of said casing, and said cover includes guide pins extending into said guide slots.

6. The tree stand according to claim 1, additionally comprising locking means coupled between said casing and said cover for locking said cover in position on top of said casing.

7. The tree stand according to claim 1, additionally comprising slide shoes disposed on the underside of said clamping cylinders.

8. The tree stand according to claim 1, wherein each of said operating components comprises a cap for gripping each of said clamping cylinders.

9. The tree stand according to claim 1, wherein said cover includes gripping recesses for aiding in cover rotation.

10. The tree stand according to claim 1, wherein three spirally-curved surfaces and three clamping cylinders are provided.

11. The tree stand according to claim 1, wherein said guide piece is integrally fitted close to the casing bottom.

12. The tree stand according to claim 1, wherein said cover includes an opening formed in its center for receiving the tree trunk.

* * * * *